US005496692A

United States Patent [19]

Bertoldi et al.

[11] Patent Number: 5,496,692

[45] Date of Patent: Mar. 5, 1996

[54] SILVER HALIDE COLOR PHOTOGRAPHIC LIGHT-SENSITIVE MATERIAL

[75] Inventors: Massimo Bertoldi, Fossano; Vinicio Busatto, Savona, both of Italy

[73] Assignee: Minnesota Mining and Manufacturing Company, St. Paul, Minn.

[21] Appl. No.: 339,484

[22] Filed: Nov. 14, 1994

[30] Foreign Application Priority Data

Dec. 10, 1993 [EP] European Pat. Off. ..... 93119939

[51] Int. Cl.[6] ..... G03C 7/305; G03C 7/36

[52] U.S. Cl. ..... 430/544; 430/549; 430/557

[58] Field of Search ..... 430/544, 549, 430/557

[56] References Cited

U.S. PATENT DOCUMENTS

| | | | |
|---|---|---|---|
| 3,973,968 | 8/1976 | Fujiwhara et al. | 430/557 |
| 4,022,620 | 5/1977 | Okumura et al. | 430/557 |
| 4,524,130 | 6/1985 | Iwasa et al. | 430/544 |
| 4,980,267 | 12/1990 | Taber | 430/549 |
| 5,006,452 | 4/1991 | Bucci | 430/544 |
| 5,332,656 | 7/1994 | Bertoldi et al. | 430/549 |

FOREIGN PATENT DOCUMENTS

| | | |
|---|---|---|
| 0320691 | 6/1989 | European Pat. Off. . |
| 0356925 | 3/1990 | European Pat. Off. . |
| 0564867 | 10/1993 | European Pat. Off. . |

OTHER PUBLICATIONS

Patent application No. 08/034726 filed Mar. 22, 1993 issued Jul. 26, 1994.

*Primary Examiner*—Richard L. Schilling
*Attorney, Agent, or Firm*—Gary L. Griswold; Walter N. Kirn; Mark A. Litman

[57] ABSTRACT

Silver halide color photographic light-sensitive material which comprises a support having thereon at least one silver halide emulsion layer containing a) an alkoxybenzoylacetanilide DIR coupler having bonded to the coupling active position a group which provides a compound having a development inhibiting property when the group is released from the coupler active position upon the color development reaction, wherein said group is a 4,7-dihalogen-2-benzotriazolyl group and b) an alkoxybenzoylacetanilide yellow dye forming coupler having a 3-hydantoinyl leaving group bonded to the coupling active position to provide, upon exposure and development, color images of improved image sensitivity.

6 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a DIR (Development Inhibitor Releasing) coupler and a yellow dye forming coupler.

BACKGROUND OF THE ART

It is well known that color photographic light-sensitive materials using the substractive process for color reproduction comprise silver halide emulsion layers selectively sensitive to blue, green and red light and associated with yellow, magenta and cyan dye forming couplers which form (upon reaction with an oxidized primary amine type color developing agent) the complementary color thereof. For example, an acylacetanilide or a pivaloylacetanilide type coupler is used to form a yellow color image; a pyrazolone, pyrazolotriazole, cyanacetophenone or indazolone type coupler is used to form a magenta color image; and a phenol type coupler, such as a phenol or naphthol coupler, is used to form a cyan color image.

In general, yellow color forming couplers have chemical structures in which one hydrogen atom of the active methylene group is substituted with a releasable atom or group. Examples of such releasable atoms or groups are a fluorine atom as described in U.S. Pat. No. 3,277,155, a phenoxy group as described in U.S. Pat. No. 3,408,194, an acyloxy group as described in U.S. Pat. No. 3,447,928, a sulfoxy group as described in U.S. Pat. No. 3,415,652, a group having a saccharin structure as described in U.S. Pat. No. 3,730,722 and a hydantoinyl group as described in U.S. Pat. Nos. 3,973,968; 4,022,620; 4,404,274; 4,777,123.

It is also known to incorporate into a light sensitive color photographic material a compound capable of releasing a development inhibitor during development upon reaction with the oxidation product of a color developing agent. Typical examples of said compounds are the DIR (Development Inhibitor Releasing) couplers having a group having a development inhibiting property when released from the coupler introduced at the coupling position of the coupler. Examples of DIR couplers are described by C. R. Barr, J. R. Thirtle and P. W. Wittum, *Photographic Science and Eng.*, vol. 13. pp 74–80 (1969) and ibid. pp 214–217 (1969) or in U.S. Pat. Nos. 3,227,554, 3,615,506, 3,617,291, 3,701,783, 3,933,500, and 4,149,886.

The purpose of DIR couplers is to reduce graininess and improve sharpness of the image due to intralayer or intraimage effects (that is in the same layers or the same dye image) and improve color reproduction due to interlayer or interimage effects (that is in different layers or different dye images).

Among the DIR couplers, those having a benzotriazolyl development inhibitor releasing group are described in U.S. Pat. Nos. 3,617,291, 4,145,219 and 4,477,563, in GB Pat. Appln. 2,010,818, and in EP Pat. Appln. Nos. 115,302, 101,621 and 320,691.

EP Patent Application No. 356,925 describes a combination of a particular DIR coupler that enables release of the developed inhibitor moiety by means of a timing anchimeric release mechanism (DIAR coupler) with a particular alkoxybenzoylacetanilide yellow dye-forming coupler comprising a phenoxy group or a heterocyclic ring as coupling off group. This combination is described as useful for improving both desired interimage effect and desired matching of reactivity.

Japanese patent Application No. 02-250,053 describes the combination of a malonodianilide DIR or DIAR coupler and a benzoyl acetanilide yellow coupler. The DIR couplers therein described compose those having a benzotriazolyl group bonded to the coupling active position through the 1-nitrogen atom or through the 2-nitrogen atom of the benzotriazole group. This benzotriazole group does not possess any substituents at positions 4 and 7. The combination is described in this Patent Application as giving improved interimage effects.

Combinations of DIR couplers and yellow dye forming couplers have been described in GB Pat. Appln. 2,099,167 and U.S. patent application Ser. No. 4,022,620. Such combinations of yellow dye forming couplers and DIR couplers, however, have not been found to provide the desired match in reactivity and the desired interimage effect.

EP Patent Application No. 564,867 describes a combination of a diacylaminomethylene development inhibitor releasing coupler having bonded to the coupling active position a 4,7-dihalogen-2-benzotriazolyl group and an alkoxybenzoylacetanilide yellow dye forming coupler having a 3-hydantoinyl leaving group bonded to the coupling active position to improve interimage effects.

For high sensitivity materials, there is the need to provide combinations of DIR couplers and yellow dye forming couplers which enable increased sensitivity without decreasing other photographic properties.

SUMMARY OF THE INVENTION

The present invention relates to a silver halide color photographic light-sensitive material which comprises a support having thereon at least one silver halide emulsion layer containing a) an alkoxybenzoylacetanilide DIR coupler having bonded to the coupling active position a 4,7-dihalogen-2-benzotriazolyl group and b) an alkoxybenzoylacetanilide yellow dye forming coupler having a 3-hydantoinyl leaving group bonded to the coupling active position.

Said silver halide color light-sensitive material provides, upon exposure and development, color images of improved image sensitivity.

DETAILED DESCRIPTION OF THE INVENTION

The present invention relates to a silver halide color photographic light—sensitive material which comprises a support having coated thereon at least one silver halide emulsion layer containing a) an alkoxybenzoylacetanilide DIR coupler having, bonded directly to the coupling active position, a group which provides a compound having a development inhibiting property when the group is released from the coupler active position upon a color development reaction, wherein said group is a 4,7-dihalogen-2-benzotriazolyl group and b) an alkoxybenzoylacetanilide yellow dye forming coupler having a 3-hydantoinyl leaving group bonded to the coupling active position.

In the present invention, said alkoxybenzoylacetanilide DIR coupler may be represented by the general formula (I):

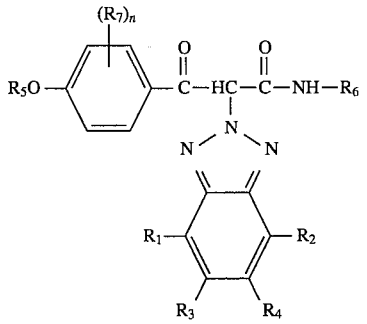

(I)

wherein $R_1$ and $R_2$, the same or different, each represents a halogen atom (chlorine, bromine, iodine and fluorine); $R_3$ and $R_4$, the same or different, each represents a hydrogen atom, a halogen atom (chlorine, bromine, iodine and fluorine), an amino group, an alkyl group having 1 to 4 carbon atoms (methyl, ethyl, buthyl, chloromethyl, trifluoromethyl, 2-hydroxyethyl, etc.), an alkoxy group having 1 to 4 carbon atoms (methoxy, chloromethoxy, ethoxy, butoxy, etc.), a hydroxy group, a cyano group, an aryloxy group (phenoxy, p-methoxyphenoxy, etc.), an acyloxy group (acyloxy, benzoyloxy, etc.), an acyl group (acyl, benzoyl, etc.), an alkoxycarbonyl group (methoxycarbonyl, butyloxycarbonyl, etc.), an aryloxycarbonyl group (benzoxycarbonyl, etc.), an acylamino group (acetamido, benzamido, etc.), an alkylsulfonyl group (methylsulfonyl, chloromethylsulfonyl, etc.), an arylsulfonyl group (phenylsulfonyl, naphthylsulfonyl, etc.), an alkoxysulfonyl group (ethoxysulfonyl, butoxysulfonyl, etc.), an aryloxysulfonyl group (phenoxysulfonyl, 2-methoxyphenoxysulfonyl, etc.) or an ureido group (phenylureido, butaneureido, etc); R5 represents an alkyl group (of 1 to 20 carbon atoms); R6 represents an alkyl group (of 1 to 20 carbon atoms) or an aryl group (of 6 to 20 carbon atoms, especially a phenyl group) and R7 represents an alkyl group (substituted or unsubstituted) having 1 to 4 carbon atoms (such as methyl, ethyl, propyl, butyl, chloromethyl, trifluoromethyl, etc.), aryl group (substituted or unsubstituted, preferably having 6 to 10 carbon atoms, such as phenyl, tolyl, benzyl, etc.), chloro atom, bromo atom or alkoxy group (preferably having 1 to 15 carbon atoms, such as methoxy, isopropoxy, octyloxy, etc.); n is 0, 1 or 2;

In the formula (I) above, the alkyl group represented by R5 and R6 has preferably from 1 to 18 carbon atoms and may be substituted or unsubstituted. Preferred examples of substituents of the alkyl group include an alkoxy group, an aryloxy group, a cyano, an amino group, an acylamino group, a halogen atom, an hydroxy group, a carboxy group, a sulfo group, an heterocyclic group, etc. Practical examples of useful alkyl groups are an isopropyl group, an isobutyl group, a tert-butyl group, an isoamyl group, a tert-amyl group, a 1,1-dimethylbutyl group, a 1,1 -dimethylhexyl group, a 1,1-diethylhexyl group, a 1,1-dimethyl-1-methoxyphenoxymethyl group, a 1,1-dimethyl-1-ethylthiomethyl group, a dodecyl group, a hexadecyl group, an octadecyl group, a cyclohexyl group, a 2-methoxyisopropyl group, a 2-phenoxyispropyl group, an α-aminoisopropyl group, an α-succinimidoisopropyl group, etc.

When the term "group" is used to describe a chemical compound or substituent, the described chemical material includes the basic group and that group with conventional substitution. Where the term "moiety" is used to describe a chemical compound or substituent only an unsubstituted chemical material is intended to be included. For example, "alkyl group" includes not only such alkyl moieties as methyl, ethyl, octyl, stearyl, etc., but also such moieties bearing substituent groups such as halogen, cyano, hydroxyl, nitro, amine, carboxylate, etc. On the other hand, "alkyl moiety" includes only methyl, ethyl, octyl, stearyl, cyclohexyl, etc.

In particular, the alkoxybenzoylacetanilide DIR coupler for use in the present invention is represented by the general formula (II):

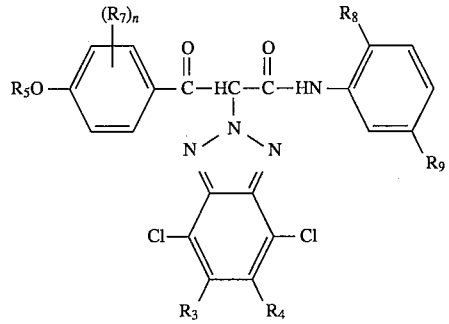

(II)

wherein $R_3$, $R_4$, $R_5$, $R_7$ and n are the same as in Formula (I); $R_8$ represents a hydrogen atom or a halogen atom (chlorine, bromine, iodine and fluorine); $R_9$ represents a halogen atom, a nitro group, a cyano group, a thiocyano group, a hydroxy group, an alkoxy group (preferably having 1 to 15 carbon atoms, such as methoxy, isopropoxy, octyloxy, etc.), an aryloxy group (preferably having up to 20 carbon atoms, such as phenoxy, nitrophenoxy, etc.), an alkyl group (preferably having 1 to 15 carbon atoms, such as methyl, ethyl, dodecyl, etc.), an alkenyl group (preferably having 1 to 15 carbon atoms, such as allyl), an aryl group (preferably having up to 10 carbon atoms, e.g., 6 to 10 carbon atoms), such as phenyl, tolyl, etc.), an amino group (e.g. an unsubstituted amino group or an alkylamino group having 1 to 15 carbon atoms such as diethylamino, octylamino, etc.), a carboxy group, an acyl group (preferably having 2 to 16 carbon atoms such as acetyl, decanoyl, etc.), an alkoxycarbonyl group (preferably having the alkyl moiety of 1 to 20 carbon atoms, such as methoxycarbonyl, butoxy-carbonyl, octyloxycarbonyl, dodecyloxycarbonyl, 2-methoxyethoxycarbonyl, etc.), an aryloxycarbonyl group (preferably having the aryl moiety of 6 to 20 carbon atoms, such as phenoxycarbonyl, tolyloxycarbonyl, tolyoxycarbonyl, etc.), a carbamoyl group (such as ethylcarbamoyl, octylcarbamoyl, etc.), an acylamino group (preferably having 2 to 21 carbon atoms, such as acetamido, octanamido, 2,4-ditert-pentylphenoxyacetamido, etc.), a sulfo group, an alkylsulfonyl group (preferably having 1 to 15 carbon atoms, such as methylsulfonyl, octylsulfonyl, etc.), an arylsulfonyl (preferably having 6 to 20 carbon atoms, such as phenylsulfonyl, octyloxyphenylsulfonyl, etc.), an alkoxysulfonyl (preferably having 1 to 15 carbon atoms, such as methoxysulfonyl, octyloxysulfonyl, etc.), an aryloxysulfonyl (preferably having 6 to 20 carbon atoms, such as phenoxysulfonyl, etc.), a sulfamoyl group (preferably having 1 to 15 carbon atoms, such as diethylsulfamoyl, octylsulfamoyl, methyloctadecylsulfamoyl, etc.), a sulfonamino group (preferably having 1 to 15 carbon atoms, such as methylsulfonamino, octylsulfonamino, etc.) and the like.

The total number of carbon atoms contributed by R9 is preferably from 6 to 35.

More in particular, the alkoxybenzoylacetanilide DIR coupler for use in the present invention is represented by the general formula (III):

(III)

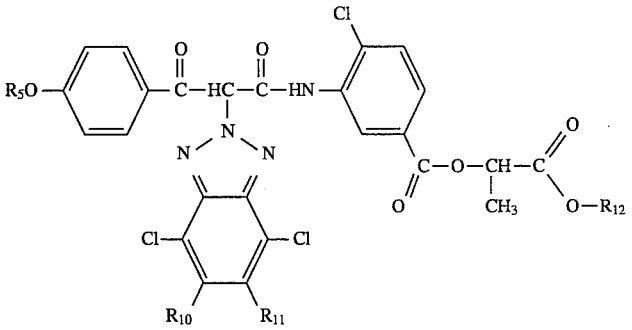

wherein $R_5$ is the same as in Formula (I); $R_{10}$ and $R_{11}$ each represents a lower alkyl group, having 1 to 4 carbon atoms (such as methyl, ethyl, butyl, etc.); $R_{12}$ represents an alkyl group, having 1 to 20 carbon atoms (such as methyl, ethyl, dodecyl, etc.).

Specific examples of alkoxybenzoylacetanilide DIR couplers for use in the present invention are given below as illustrative examples.

DIR Coupler 1

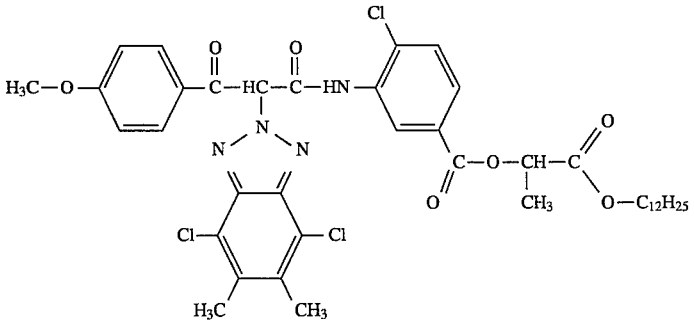

DIR Coupler 2

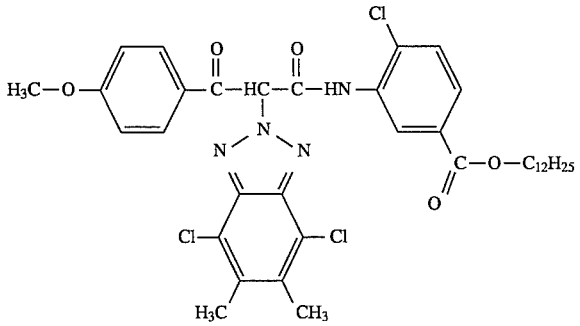

DIR Coupler 3

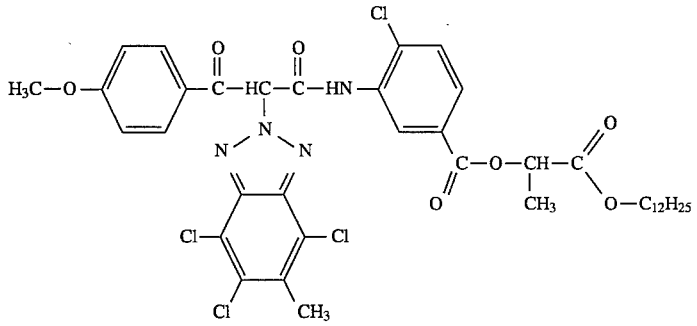

-continued

DIR Coupler 4

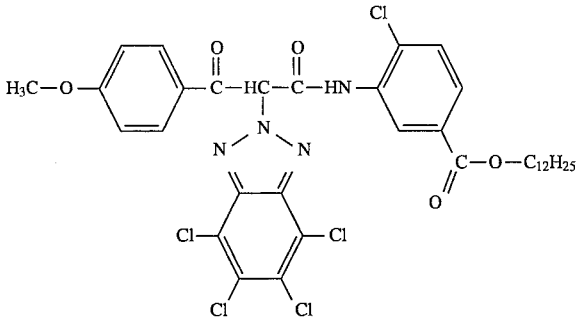

DIR Coupler 5

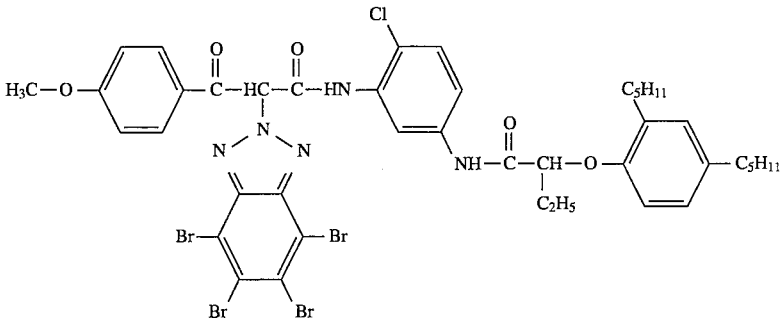

DIR Coupler 6

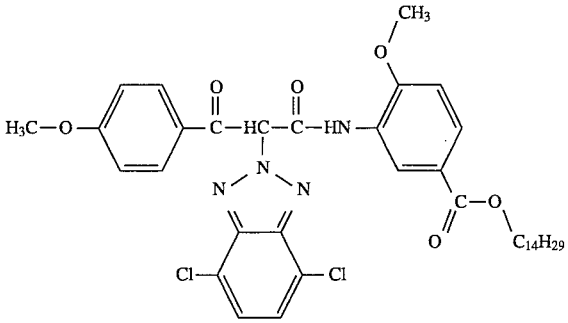

The DIR couplers for use in the present invention can be synthesized according to conventional means for synthesizing DIR couplers. A typical example of synthesis of the DIR couplers for use in the present invention is given below.

SYNTHESIS EXAMPLE 1

Synthesis of DIR coupler (1)

4-Chloro-3-{[2-(4,7-Dichloro-5,6-Dimethybenztriaz-2-yl)-3-(4-Methoxyphenyl)-1,3-Dioxopropyl]-amino}Benzoic Acid 2-(Dodecyloxy)-1-Methyl-2-Oxoethyl Ester To a solution of 11.9 g of 4-Chloro-3-{[-3-(4-Methoxyphenyl)-1,3-Dioxopropyl]-amino}Benzoic Acid 2-(Dodecyloxy)-1-Methyl-2-Oxoethyl Ester in 60 ml. of toluene were added 2.8 g of sulfuryl chloride. After stirring for 3 hours, the organic solution was washed with water, dried over sodium sulfate and concentrated under vacuum. The oil obtained was diluted with 50 cc DMF and added to a suspension of 4.2 g 5,6-dimethyl-4,7-dichlorobenzotriazole, 4.3 g of $Na_2CO_3$ and 50 cc DMF. After stirring for two hours at room temperature, the solution was poored in a 100 cc of water acidified to pH 1 with HCl. After standing overnight, a yellow crude product was collected. After crystallization from a solution of ethyl acetate, 10 g of pure product were obtained.

The structure of the above coupler was confirmed by elemental analysis, IR spectra and $^1H$ and $^{13}C$ spectra. The 2-nitrogen bond was confirmed also by Thermospray-Mass Spectroscopy analysis.

The alkoxybenzoylacetanilide DIR couplers of the present invention can be hydrophilic couplers (Fischer type couplers) having a water-solubilizing group, for example a carboxy group, a hydroxy group, a sulfo group, etc., or hydrophobic couplers. As methods for adding the couplers to a hydrophilic colloid solution or to a gelatino-silver halide photographic emulsion or dispersing said couplers thereof, those methods conventionally known in the art can be applied. For example, hydrophobic couplers of the present invention can be dissolved in a high boiling water insoluble solvent and the resulting solution emulsified into an aqueous medium as described for example in U.S. Pat. Nos. 2,304,939, 2,322,027, etc., or said hydrophobic couplers are dissolved in said high boiling water insoluble organic solvent in combination with low boiling organic solvents and the resulting solution emulsified into the aqueous medium as described for example in U.S. Pat. Nos. 2,801,170, 2,801,171, 2,949,360, etc.

The alkoxybenzoylacetanilide yellow dye forming coupler for use in the present invention may be represented by the general formula (IV):

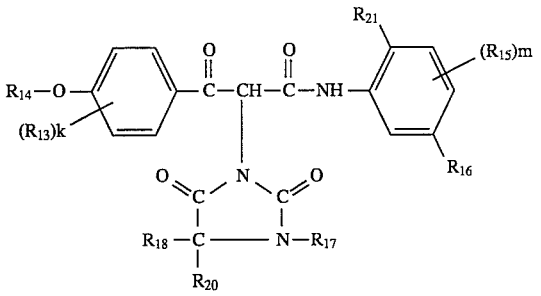

(IV)

wherein $R_{13}$ and $R_{15}$ each represents an alkyl group (substituted or unsubstituted) having 1 to 4 carbon atoms (such as methyl, ethyl, propyl, butyl, chloromethyl, trifluoromethyl, etc.), aryl group (substituted or unsubstituted, preferably having 6 to 10 carbon atoms, such as phenyl, tolyl, benzyl, etc.), chloro atom, bromo atom or alkoxy group (preferably having 1 to 15 carbon atoms, such as methoxy, isopropoxy, octyloxy, etc.); k and m are individually 0, 1 or 2; $R_{14}$ is an alkyl group (substituted or unsubstitued) having 1 to 4 carbon atoms (such as methyl, ethyl, propyl, butyl, chloromethyl, trifluoromethyl, etc.); $R_{16}$ is a ballast group; $R_{17}$ represents a hydrogen atom, an alkyl group (substituted or unsubstitued, such as methyl, ethyl, propyl, isopropyl, amyl, isoamyl, exyl, carboxymethyl, hexadecyl, etc.), an aryl group (substituted or unsubstitued, such as phenyl group and naphthyl group) or an acyl group (such as acetyl, propionyl, octanoyl, benzoyl, etc.); $R_{18}$ is hydrogen atom, an alkyl group (substituted or unsubstitued, such as methyl, ethyl, propyl, isopropyl, amyl, isoamyl, exyl, carboxymethyl, hexadecyl, etc.), —O-$R_{19}$ or —S—$R_{19}$, wherein $R_{19}$ is hydrogen atom, an alkyl group (substituted or unsubstitued, such as methyl, ethyl, propyl, isopropyl, amyl, isoamyl, exyl, carboxymethyl, hexadecyl, etc.), an aryl group (substituted or unsubstitued, such as phenyl group and naphthyl group), a hetetocyclic group bonded to the oxygen atom or to the sulfur atom through one carbon atom forming said hetrocyclic ring such as 2-tetrahydropyranyl group, a 2-pyridyl group or a 4-pyridyl group and the like, or an acyl group (such as acetyl, propionyl, octanoyl, benzoyl, etc.); $R_{20}$ is hydrogen atom, an alkyl group (substituted or unsubstitued, such as methyl, ethyl, propyl, isopropyl, amyl, isoamyl, exyl, carboxymethyl, hexadecyl, etc.), or an aryl group (substituted or unsubstitued, such as phenyl group and naphthyl group); $R_{21}$ is halogen atom (chlorine, bromine, iodine and fluorine) or an alkoxy group having 1 to 15 carbon atoms (methoxy, chloromethoxy, ethoxy, butoxy, etc.) group.

The ballasting group represented by $R_{16}$ in Formula (IV) above acts as a "ballast" which can maintain the yellow coupler in a specific layer so as to substantially prevent said coupler from diffusing to any other layer in a multilayer color photographic element. The group has a sufficient bulkiness to complete that purpose. Usually a group having a hydrophobic group of 8 to 32 carbon atoms is introduced in the coupler molecule as ballasting group. Such group can be bonded to the coupler molecule directly or through an amino, ether, carbonamido, sulfonamido, ureido, ester, imido, carbamoyl, sulfamoyl, phenylene, etc., bond. Specific examples of ballasting groups are illustrated in U.S. Pat. No. 4,009,083, in European Pat. Nos. 87,930, 84,100, 87,931, 73,146, and 88,563, in German Pat. Nos. 3,300,412 and 3,315,012, in Japanese Pat. Nos. 58/33248, 58/33250, 58/31334, 58/106539. Preferably, such ballasting groups comprise alkyl chains, the total carbon atoms of which are no more than 20.

In particular, in the present invention, said alkoxybenzoylacetanilide yellow dye forming coupler is represented by the general formula (V):

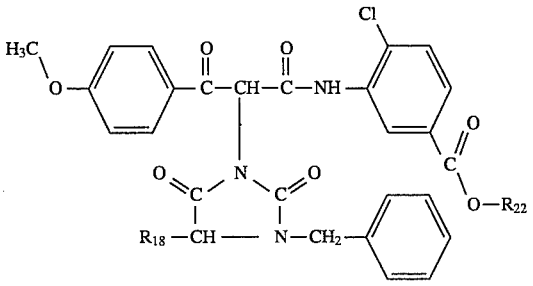

(V)

wherein $R_{18}$ is the same as in formula (IV) and $R_{22}$ is an alkyl group having 8 to 32 carbon.

Specific examples of alkoxybenzoylacetanilide yellow dye forming couplers of the present invention are given below as illustrative examples.

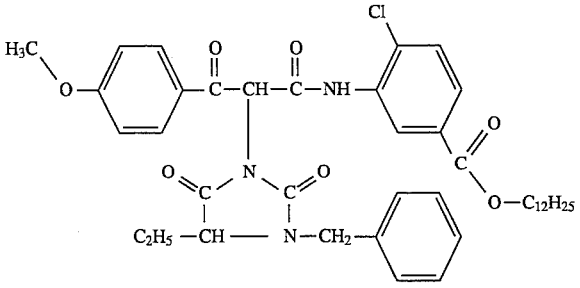

(1)

-continued
(2)
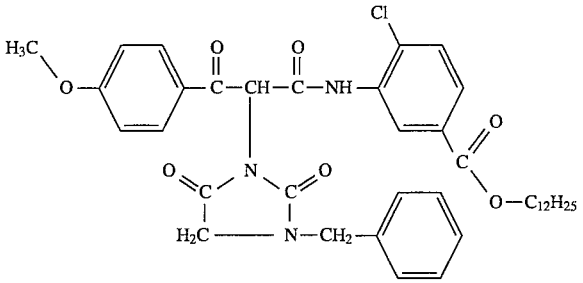
(3)
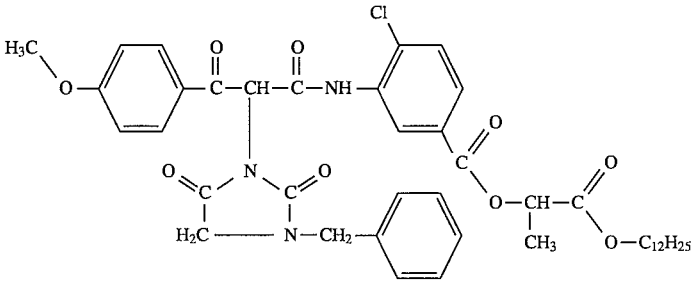
(4)
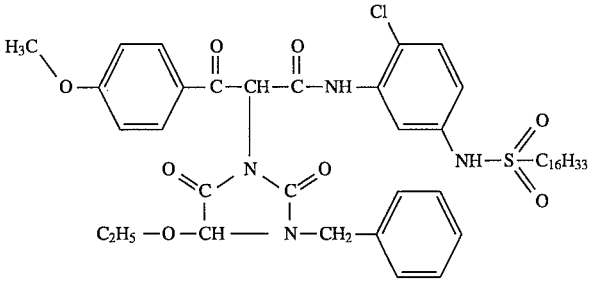
(5)
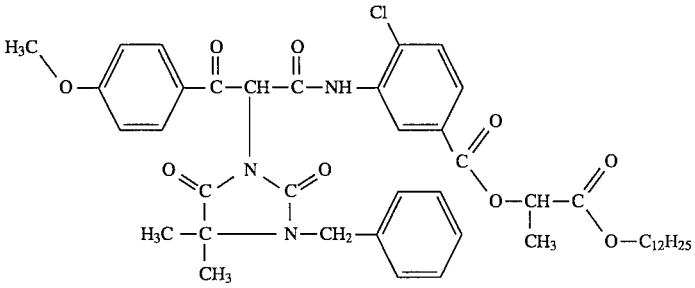
(6)
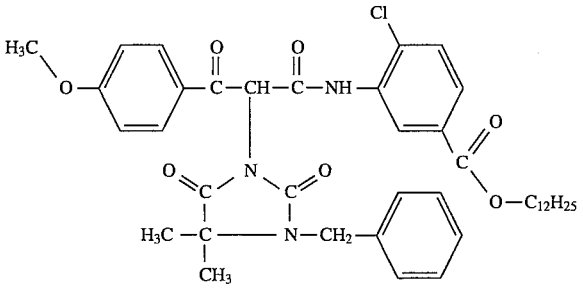

-continued (7)

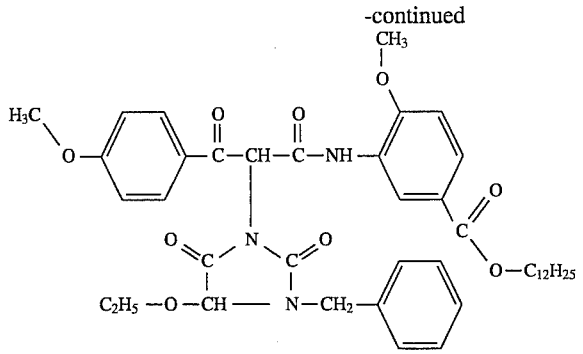

(8)

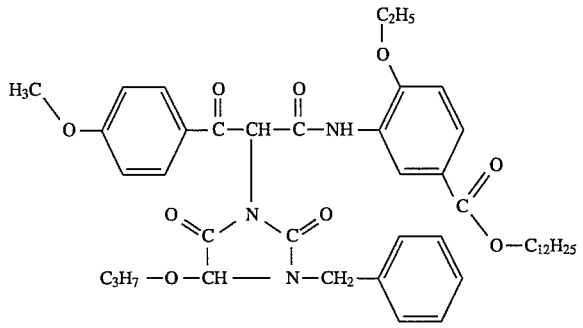

(9)

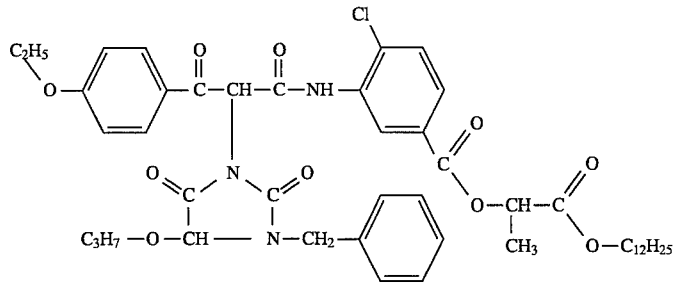

(10)

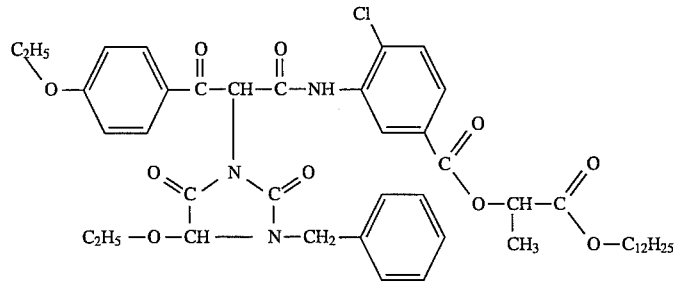

The yellow couplers for use in the present invention can be synthesised according to conventional means for synthesizing yellow couplers. For example yellow coupler 1 can be synthesized as described in Research Disclosure April 1979 No. 18053 p. 198.

The alkoxybenzoylacetanilide DIR coupler and the alkoxybenzoylacetanilide yellow dye forming coupler for use in the present invention are dispersed in the emulsion layer(s) in an amount in the range from 0.5 to 5 moles of the benzoyl yellow dye forming DIR coupler for 100 moles of the alkoxybenzoylacetanilide yellow dye forming coupler, preferably from 1.0 to 2.5 mols per 100 mols.

The photographic elements of the present invention are preferably multi-layer color elements comprising a blue sensitive or sensitized silver halide emulsion layer associated with yellow dye-forming color couplers, a green sensitized silver halide emulsion layer associated with magenta dye-forming color couplers and a red sensitized silver halide emulsion layer associated with cyan dyed-forming color couplers. Each layer can be comprised of a single emulsion layer or of multiple emulsion sub-layers sensitive to a given region of visible spectrum. When multi-layer materials contain multiple blue, green or red sub-layers, there can be in any case relatively faster and relatively slower sub-layers.

The silver halide emulsion used in this invention may be a fine dispersion of silver chloride, silver bromide, silver chloro-bromide, silver iodo-bromide and silver chloro-iodo-bromide in a hydrophilic binder. As hydrophilic binder, any hydrophilic polymer of those conventionally used in photography can be advantageously employed including gelatin, a gelatin derivative such as acylated gelatin, graft gelatin, etc., albumin, gum arabic, agar agar, a cellulose derivative, such as hydroxyethyl-cellulose, carboxymethyl-cellulose, etc., a synthetic resin, such as polyvinyl alcohol, polyvinylpyrrolidone, polyacrylamide, etc. Preferred silver halides are silver iodo-bromide or silver iodo-bromo-chloride containing 1 to 20% mole silver iodide. The silver halide grains may have any crystal form such as cubic, octahedral, tabular or a mixed crystal form. The silver halide can have a uniform grain size or a broad grain size distribution. The size of the silver halide ranges from about 0. 1 to about 5 μm. The silver halide emulsion can be prepared using a single-jet method, a double-jet method, or a combination of these methods and can be matured using, for instance, an ammonia method, a neutralization method, an acid method, etc. The emulsions which can be used in the present invention can be chemically and optically sensitized as described in Research Disclosure 17643, III and IV, December 1978; they can contain optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, December 1978. The layers of the photographic emulsion and the layers of the photographic element can contain various colloids, alone or in combination, such as binding materials, as for instance described in Research Disclosure 17643, IX, December 1978. The above described emulsions can be coated onto several support bases (cellulose triacetate, paper, resin-coated paper, polyester included) by adopting various methods, as described in Research Disclosure 17643, XV and XVII, December 1978. The light-sensitive silver halides contained in the photographic elements of the present invention after exposure can be processed to form a visible image by associating the silver halide with an aqueous alkaline medium in the presence of a developing agent contained in the medium or in the element. Processing formulations and techniques are described in Research Disclosure 17643, XIX, XX and XXI, December 1978.

The present invention will be now illustrated in greater detail by reference to the following examples.

EXAMPLE 1

Sample 1 (Invention)

A multilayer negative color film was made by coating a subbed cellulose triacetate support base with layers in the following order:

Layer 1. Silver antihalation layer at a total silver coverage of 0.27 g/m$^2$ and a gelatin coverage of 1.33 g/m$^2$;

Layer 2. An intermediate layer containing 0.97 g/m$^2$ of gelatin;

Layer 3. Low sensitivity green-sensitive magenta dye forming silver halide emulsion layer comprising a blend consisting of 63% w/w of a low-sensitivity silver bromo iodide emulsion (having 2.5% silver iodide moles and a mean grain size of 0.18 μm) and 37% w/w of a medium-sensitivity silver chloro-bromo-iodide emulsion (having 7% silver iodide moles and 5% silver chloride moles and a mean grain size of 0.45 μm). The low and medium emulsions were both chemically sensitized with sulfur and gold compounds, added with stabilizers, antifogging agents and green spectral sensitizing dyes. The layer was coated at a total silver coverage of 1.62 g/m$^2$, gelatin coverage of 1.44 g/m$^2$, 0.503 g/m$^2$ of the magenta dye forming coupler A, 0.016 g/m$^2$ of the magenta dye forming DIR coupler B, 0.074 g/m$^2$ of the yellow colored magenta dye forming coupler C and 0.147 g/m$^2$ of the yellow colored magenta dye forming coupler D.

Layer 4. A more sensitive green sensitive magenta dye forming silver halide emulsion layer comprising a silver bromo-iodide emulsion (having 12% silver iodide moles and a mean grain size of 0.11 μm) at a silver coverage of 1.60 g/m$^2$ and a gelatin coverage of 1.03 g/m$^2$, chemically sensitized with sulfur and gold compounds, added with stabilizers and antifogging compounds. The layer was coated with 0.498 g/m$^2$ of the magenta dye forming coupler A, 0.016 g/m$^2$ of the magenta dye forming DIR coupler B, 0.021 g/m$^2$ of the yellow colored magenta dye forming coupler C and 0.042 g/m$^2$ of the yellow colored magenta dye forming coupler D.

Layer 5. An intermediate layer containing 1.06 g/m$^2$ of gelatin;

Layer 6. Yellow colloidal silver filter layer at a total silver coverage 0.048 g/m$^2$ and a gelatin coverage of 1.18 g/m$^2$, comprising a dichloro-hydroxy-triazine gelatin hardener.

Layer 7. Low sensitivity blue sensitive yellow dye forming silver halide emulsion layer comprising a blend of 60% w/w of a low-sensitivity silver bromo iodide emulsion (having 2.5% silver iodide moles and a mean grain size of 0.18 μm) and 40% w/w of a silver chloro-bromo-iodide emulsion (having 7% silver iodide moles and 5% silver chloride moles and a mean grain size of 0.45 μm) at a total silver coverage of 0.51 g/m$^2$ and a gelatin coverage of 1.59 g/m$^2$. The low and medium sensitivity emulsions were both chemically sensitized with sulfur and gold compounds, added with stabilizers, antifogging agents and blue spectral sensitizing dyes. The layer was coated with 1.027 g/m$^2$ of methoxy benzoyl acetanilide yellow dye forming coupler 1 and 0.029 g/m$^2$ of methoxy benzoyl acetanilide DIR coupler 1.

Layer 8. A more sensitive blue sensitive yellow dye forming silver halide emulsion layer comprising a silver bromo-iodide emulsion (having 12% silver iodide moles and a mean grain size of 0.11 μm) at a silver coverage of 0.90 g/m$^2$ and a gelatin coverage of 1.24 g/m$^2$, chemically sensitized with sulfur and gold compounds, added with stabilizers and antifogging compounds and blue spectral sensitizing dyes. The layer was coated with 0.829 g/m$^2$ of methoxy benzoyl acetanilide yellow dye forming coupler 1 and 0.029 g/m$^2$ of methoxy benzoyl acetanilide DIR coupler 1.

Layer 9. First protective gelatin layer comprising gelatin at a coverage of 1.28 g/m$^2$;

Layer 10. Second protective gelatin layer comprising of gelatin hardener (dichlorohydroxytriazine) and matting agent (polymethylmethacrylate).

Sample 2 (Invention)

A multilayer negative color film was made by coating a subbed cellulose triacetate support base as in Example 1, but the methoxy benzoyl acetanilide DIR coupler 1 in layers 7 and 8 was replaced by equimolecular amounts of the methoxy benzoyl acetanilide DIR coupler 2.

Sample 3 (Invention)

A multilayer negative color film was made by coating a subbed cellulose triacetate support base as in Example 1, but the methoxy benzoyl acetanilide DIR coupler 1 in layers 7 and 8 was replaced by equimolecular amounts of the methoxy benzoyl acetanilide DIR coupler 3.

Sample 4 (Comparison)

A control multilayer negative color film was made by coating a subbed cellulose triacetate support base as in Example 1, but the methoxy benzoyl acetanilide DIR coupler 1 in layers 7 and 8 was replaced by equimolecular amounts of the yellow dye forming DIR coupler E.

Sample 5 (Comparison)

A control multilayer negative color film was made by coating a subbed cellulose triacetate support base as in Example 1, but the methoxy benzoyl acetanilide DIR coupler 1 in layers 7 and 8 was replaced by equimolecular amounts of the yellow dye forming DIR coupler F.

Sample 6 (Comparison)

A control multilayer negative color film was made by coating a subbed cellulose triacetate support base as in Example 1, but the methoxy benzoyl acetanilide DIR coupler 1 in layers 7 and 8 was replaced by equimolecular amounts of the yellow dye forming DIR coupler G.

Samples of each film were exposed for a 1/20 of a second to a light source having a color temperature of 5,500 Kelvin through a WRATTEN™ W99 filter and an optical step wedge (selective exposure). Other samples of each film were exposed as above but without using any filter (white light exposure). All the exposed samples were developed in a standard type C41 process as described in *British Journal of Photography*, Jul. 12, 1974, pp. 597–598. The samples were then sensitometrically examined in both yellow and magenta layers. S1 is the sensitivity value measured in Log E, wherein E is expressed in lux.seconds at a density of 0.2 above Dmin, while S2 has been measured in the same way, but at a density of 1.0 above Dmin. To evaluate the interimage effects, the contrasts of the obtained sensitometric curves for selective exposures ($gamma_s$) and white light exposures ($gamma_w$) were measured in the low dye-density or toe region (C1) and in the high dye-density or shoulder region (C2) of each sensitometric curve. Tables 1 reports the sensitometric values and Table 2 reports the value of $$R = \frac{gamma_s - gamma_w}{gamma_w} \times 100$$

The higher the R values, the better are the interimage effects.

TABLE 1

| | Yellow Layer | | | Magenta Layer | | | R | |
|---|---|---|---|---|---|---|---|---|
| Sample | Dmax | S1 | S2 | Dmax | S1 | S2 | C1 | C2 |
| 1 (inv.) | 3.17 | 2.37 | 1.58 | 2.59 | 2.25 | 0.98 | 51.8 | 37.1 |
| 2 (inv.) | 3.08 | 2.36 | 1.57 | 2.64 | 2.28 | 1.07 | 41.4 | 29.7 |
| 3 (inv.) | 3.03 | 2.35 | 1.54 | 2.65 | 2.29 | 1.09 | 41.4 | 28.4 |
| 4 (comp.) | 3.13 | 2.31 | 1.42 | 2.50 | 2.16 | 0.87 | 51.8 | 32.9 |
| 5 (comp.) | 3.15 | 2.32 | 1.49 | 2.67 | 2.22 | 0.94 | 52.7 | 35.2 |
| 6 (comp.) | 3.24 | 2.30 | 1.48 | 2.67 | 2.22 | 0.97 | 37.9 | 21.1 |

Samples 1–3 comprising the combination of an alkoxybenzoylacetanilide yellow dye forming coupler and an alkoxybenzoylacetanilide DIR coupler, according to the present invention, shows improved sensitivity in both yellow layer and in magenta layer with respect to the comparison samples 4–6, wherein different yellow dye forming DIP, couplers have been used, still maintaining good Dmax values and good interimage effects.

Magenta dye forming Coupler A:

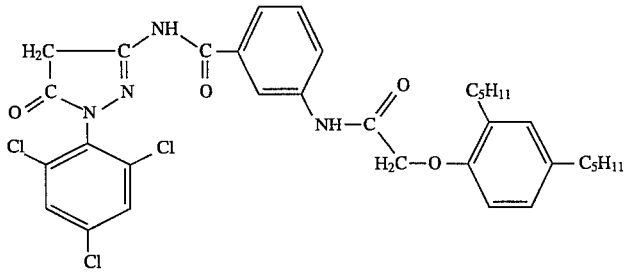

Magenta dye forming DIR Coupler B:

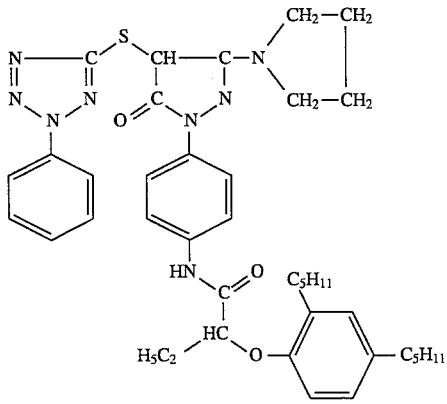

-continued
Yellow colored magenta dye forming Coupler C:
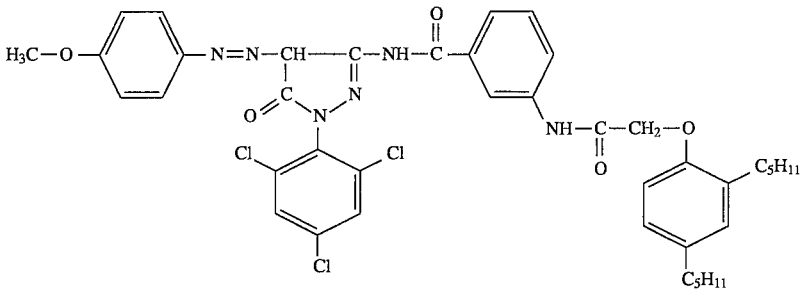
Yellow colored magenta dye forming Coupler D:
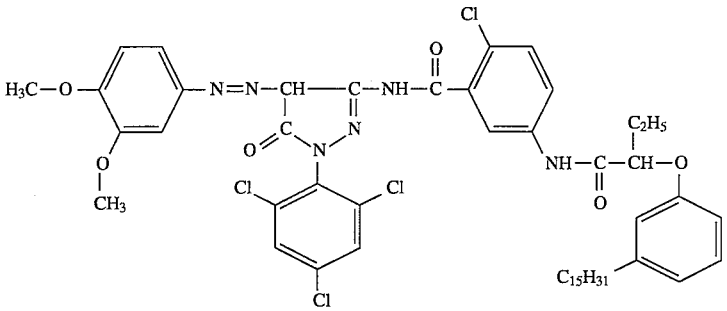
Yellow dye forming DIR Coupler E (Comparison):
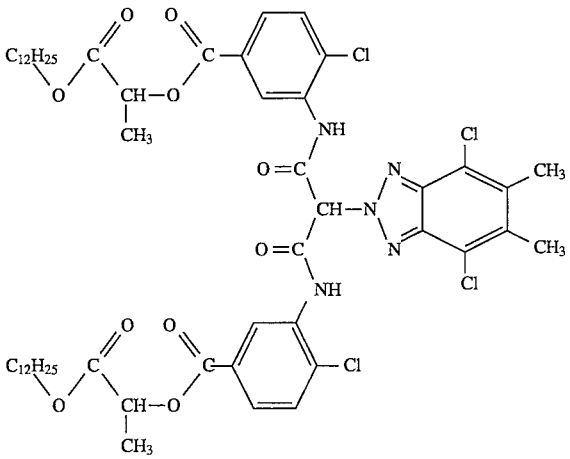
Yellow dye forming DIR Coupler F (Comparison)
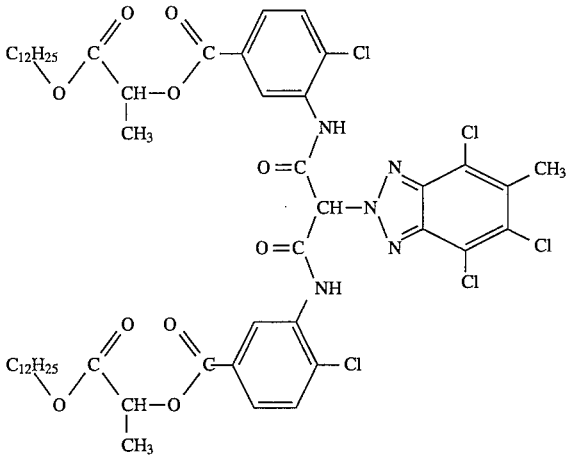

-continued

Yellow dye forming DIR Coupler G (Comparison)

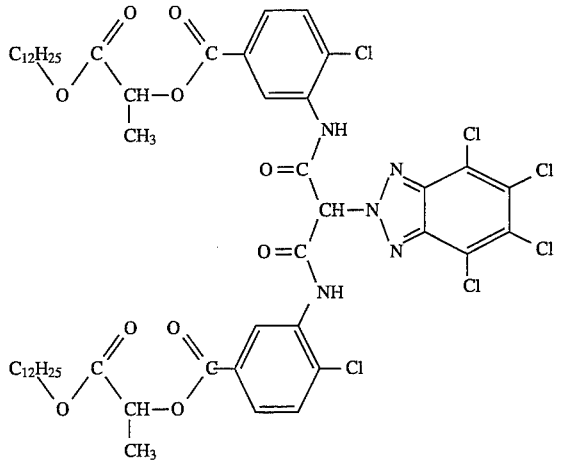

EXAMPLE 2

Sample 7 (invention)

A multilayer negative color film was prepared by coating a cellulose triacetate support base, subbed with gelatin, with the following layers in the following order:

(a) a layer of black colloidal silver dispersed in gelatin having a silver coverage of 0.27 g/m$^2$ and a gelatin coverage of 1.33 g/m$^2$;

(b) an intermediate layer containing 0.97 g/m$^2$ of gelatin;

(c) a layer of low sensitivity red-sensitive silver halide emulsion comprising a low-sensitivity silver bromoiodide emulsion (having 2.5% silver iodide moles and a mean grain size of 0.181 μm) at a total silver coverage of 0.71 g/m$^2$ and a gelatin coverage of 0.94 g/m$^2$, containing the cyan-dye forming coupler H at a coverage of 0.354 g/m$^2$, the cyan-dye forming DIR coupler I at a coverage of 0.024 g/m$^2$ and the magenta colored cyan-dye forming coupler J at a coverage of 0.043 g/m$^2$, dispersed in a mixture of tricresylphosphate and butylacetanilide;

(d) a layer of medium-sensitivity red-sensitive silver halide emulsion comprising a silver chloro-bromo-iodide emulsion (having 7% silver iodide moles and 5% silver chloride moles and a mean grain size of 0.45 μm) at a silver coverage of 0.84 g/m$^2$ and a gelatin coverage of 0.83 g/m$^2$, containing the cyan-dye forming coupler H at a coverage of 0.333 g/m$^2$, the cyan-dye forming DIR coupler I at a coverage of 0.022 g/m$^2$ and the magenta colored cyan-dye forming coupler J at a coverage of 0.052 g/m$^2$, dispersed in a mixture of tricresylphosphate and butylacetanilide;

(e) a layer of high-sensitivity red-sensitive silver halide emulsion comprising a silver bromo-iodide emulsion (having 12% silver iodide moles and a mean grain size of 0.11 μm) at a silver coverage of 1.54 g/m$^2$ and a gelatin coverage of 1.08 g/m$^2$, containing two cyan-dye forming couplers, the coupler H at a coverage of 0.224 g/m$^2$ and the coupler K at a coverage of 0.032 g/m$^2$, and the cyan-dye forming DIR coupler I at a coverage of 0.018 g/m$^2$, dispersed in a mixture of tricresylphosphate and butylacetanilide;

(f) an intermediate layer containing 1.11 g/m$^2$ of gelatin, comprising a dichlorolohydroxytriazine gelatin hardener;

(g) a layer of low sensitivity green sensitive silver halide emulsion comprising a blend of 63% w/w of the low-sensitivity emulsion of layer c) and 37% w/w of the medium-sensitivity emulsion of layer (d) at a silver coverage of 1.44 g/m$^2$ and a gelatin coverage of 1.54 g/m$^2$, containing the magenta-dye forming coupler A, at a coverage of 0.537 g/m$^2$, the magenta dye forming DIR coupler B at a coverage of 0.017 g/m$^2$, and the yellow colored magenta dye forming coupler C at a coverage of 0.079 g/m$^2$, the yellow coloured magenta dye forming coupler D at a coverage of 0.157 g/m$^2$, and dispersed in tricresylphosphate;

(h) a layer of high-sensitivity green sensitive silver halide emulsion comprising the emulsion of layer (e) at a silver coverage of 1.60 g/m$^2$ and a gelatin coverage of 1.03 g/m$^2$ containing the magenta dye forming coupler A, at a coverage of 0.498 g/m$^2$, the magenta dye forming DIR coupler B at a coverage of 0.016 g/m$^2$, the yellow coloured magenta dye forming coupler C at a coverage of 0.021 g/m$^2$, and the yellow colored magenta dye forming coupler D at a coverage of 0.043 g/m$^2$, dispersed in tricresylphosphate;

(i) an intermediate layer containing 1.06 g/m$^2$ of gelatin;

(j) a yellow filter layer containing 1.18 g/m$^2$ of gelatin, comprising a dichlorohydroxytriazine gelatin hardener;

(k) a layer of low-sensitivity blue-sensitive silver halide emulsion comprising a blend of 60% w/w of the low-sensitivity emulsion of layer c) and 40% w/w of the medium-sensitivity emulsion of layer (d) at a silver coverage of 0.53 g/m$^2$ and a gelatin coverage of 1.65 g/m$^2$ and the methoxy benzoyl acetanilide yellow dye forming coupler 1 at a coverage of 1.042 g/m$^2$ and the methoxy benzoyl acetanilide DIR coupler 1 at a coverage of 0.028 g/m$^2$ dispersed in a mixture of diethyllaurate and dibuthylphthalate;

(l) a layer of high-sensitivity blue sensitive silver halide emulsion comprising the emulsion of layer (e) at a silver coverage of 0.90 g/m$^2$ and a gelatin coverage of 1.24 g/m$^2$, containing the methoxy benzoyl acetanilide yellow dye-forming coupler 1 at a coverage of 0.791 g/m$^2$ and the methoxy benzoyl acetanilide DIR coupler 1 at a coverage of 0.021 g/m$^2$ dispersed in a mixture of diethyllaurate and dibuthylphthalate;

(m) a protective layer of 1.28 g/m$^2$ of gelatin; and (n) a top coat layer of 0.73 g/m$^2$ of gelatin containing 0.273 g/m$^2$ of polymethylmethacrylate beads, and dichlorohydroxytriazine hardener.

Sample 8 (comparison)

A multilayer negative color film was prepared by coating a cellulose triacetate support base, subbed with gelatin, as Sample 7, but the yellow dye forming DIR coupler 1 of layer (k) and layer (l) was replaced by the equimolecular amounts of the yellow dye forming DIR coupler E.

Sample 9 (comparison)

A multilayer negative color film was prepared by coating a cellulose triacetate support base, subbed with gelatin, as Sample 7, but the yellow dye forming coupler 1 of layer (k) and (l) was replaced by the equimolecular amounts of the yellow dye forming coupler L and the yellow dye forming DIR coupler 1 of layer (k) and (l) was replaced by the equimolecular amounts of the yellow dye forming DIR coupler E.

Samples of each film were exposed to a light source having a color temperature of 5,500 Kelvin through a WRATTEN™ W99 filter and an optical step wedge (selective exposure). Other samples of each film were exposed as above but without using any filter (white light exposure). All the exposed samples were developed in a standard type C41 process as described in *British Journal of Photography*, Jul. 12, 1974, pp. 597–598. The samples were then sensitometrically examined in the yellow and magenta layers in the same way described in example 1. Table 2 reports the sensitometric values.

TABLE 2

| | Yellow Layer | | | Magenta Layer | | | R | |
|---|---|---|---|---|---|---|---|---|
| Sample | Dmax | S1 | S2 | Dmax | S1 | S2 | C1 | C2 |
| 7 (inv.) | 3.17 | 23.0 | 12.9 | 2.37 | 22.9 | 10.6 | 24.6 | 41.9 |
| 8 (comp.) | 3.28 | 21.8 | 11.7 | 2.43 | 22.1 | 9.0 | 33.9 | 50.0 |
| 9 (cmp.) | 3.27 | 23.0 | 12.9 | 2.42 | 22.6 | 10.4 | 21.9 | 35.5 |

Sample 7 comprising the combination of an alkoxybenzoylacetanilide yellow dye forming coupler and an alkoxybenzoylacetanilide DIR coupler, according to the present invention, shows improved sensitivity in all the layers, particularly in yellow layer, with respect to the comparison sample 8, maintaining the interimage effects at acceptable values. These photographic properties are very useful in photographic materials having very high sensitivity, where a speed improvement is strongly requested, while interimage effects are not so important (a reduction up to 30% in interimage effects is still acceptable). At the same time, sample 7 of the present invention shows also better interimage effects when compared with sample 9, with a little improvement in sensitivity, giving thus improved qualities to photographic films having medium-high sensitivity.

Cyan dye forming Coupler H:

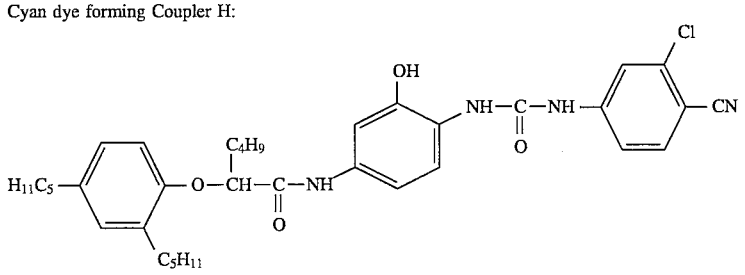

Cyan dye forming DIR Coupler I:

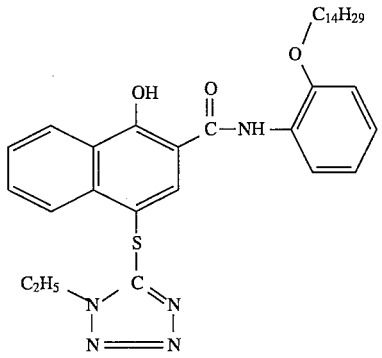

Magenta colored cyan-dye forming Coupler J:

-continued

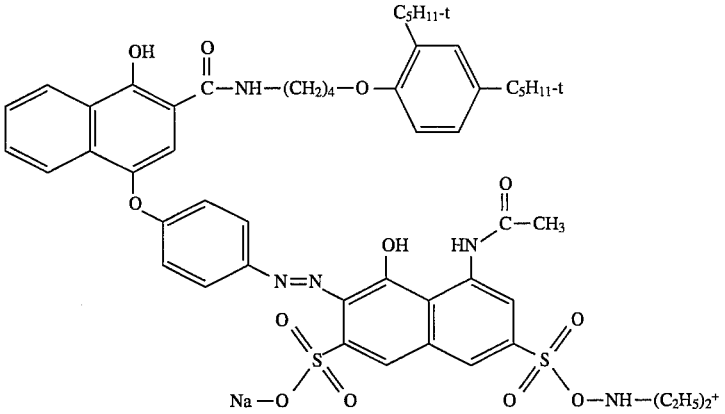

Cyan dye forming Coupler K:

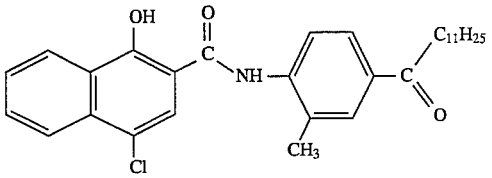

Yellow Dye Forming Coupler L:

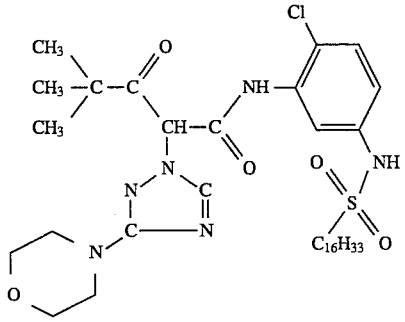

We claim:

1. A silver halide color photographic light sensitive material which comprises a support having coated thereon at least one silver halide emulsion layer containing a) an alkoxybenzoylacetanilide DIR coupler having, bonded directly to the coupling active position, a group which provides a compound having a development inhibiting property when the group is released from the coupler active position upon the color development reaction, wherein said group is a 4,7-dihalogen-2-benzotriazolyl group and b) an alkoxybenzoylacetanilide yellow dye forming coupler having a 3-hydantoinyl leaving group bonded to the coupling active position wherein said alkoxybenzoylacetanilide DIR coupler is represented by the formula:

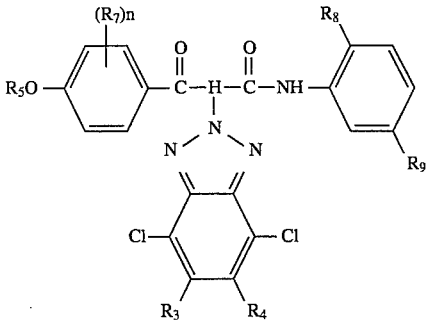

wherein $R_3$ and $R_4$ each represents a hydrogen atom, a halogen atom, an amino group, an alkyl group, an alkoxy group, an hydroxy group, a cyano group, an aryloxy group, and acyloxy group, and acyl group, an alkoxycarbonyl group, an aryloxycarbonyl group, an acylamino group, an alkylsulfonyl group, an arylsulfonyl group, an alkoxysulfonyl group, an aryloxysulfonyl group or an ureido group; $R_5$ represents an alkyl group; $R_7$ represents an alkyl group, an aryl group, a halogen atom or an alkoxy group; n is 0, 1 or 2; $R_8$ represents chlorine; $R_9$ represents an alkoxy group, an alkyl group, an alkenyl group, an aryl group, an amino group an acyl group, an alkoxycarbonyl group, an aryloxycarbonyl group, a carbamoyl group, an acylamino group, an alkylsulfonyl group, an aryl sulfonyl group, an alkoxysulfonyl group, an aryloxysulfonyl group, a sulfamoyl group, or a sulfonamido group, the total number of carbon atom represented by $R_9$ being from 6 to 35, and wherein said alkoxy benzoylacetanilide yellow dye forming coupler is represented by the general formula:

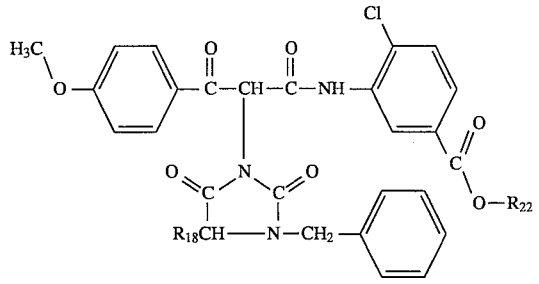

wherein $R_{18}$ is hydrogen atom, an alkyl group or —o—$R_{19}$ or —S—$R_{19}$, wherein $R_{19}$ is hydrogen atom, an alkyl group, an aryl group, a heterocyclic group or an acyl group and $R_{22}$ is an alkyl group having 8 to 32 carbon atoms.

2. The silver halide color photographic light sensitive material of claim 1, wherein said alkoxybenzoylacetanilide DIR coupler is represented by the general formula:

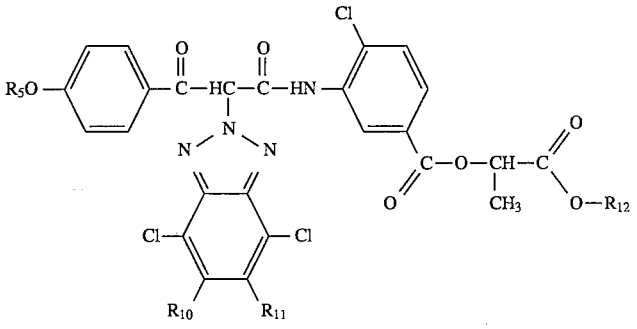

wherein $R_5$ represents an alkyl group; $R_{10}$ and $R_{11}$ each represents a lower alkyl group; $R_{12}$ represents an alkyl group.

3. The silver halide color photographic light sensitive material of claim 1, wherein said alkoxybenzoylacetanilide DIR coupler is represented by the formula:

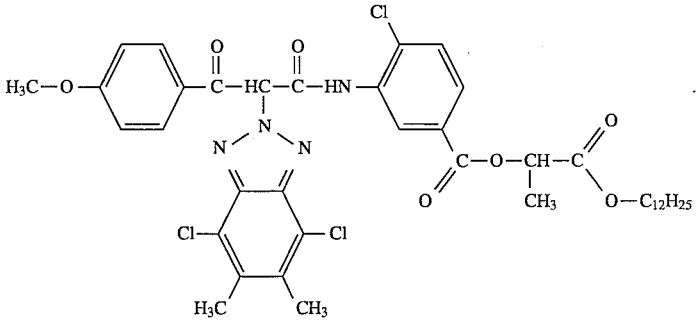

4. The silver halide color photographic light sensitive material of claim 1, wherein said alkoxybenzoylacetanilide DIR coupler is represented by the formula:

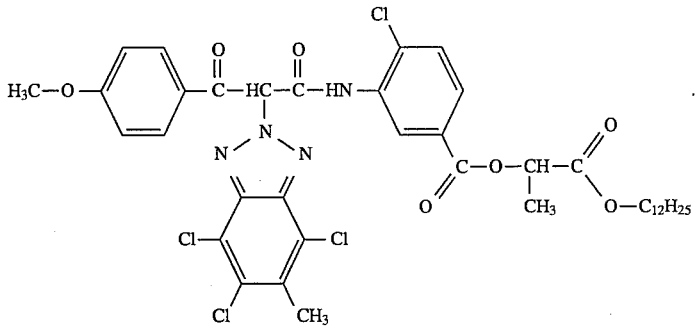

5. The silver halide color photographic light sensitive material of claim 1, wherein said alkoxybenzolyacetanilide yellow dye forming coupler is represented by the formula:

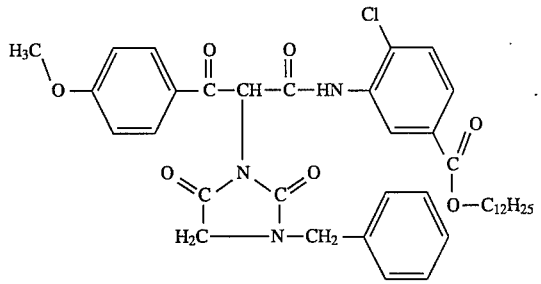

6. A silver halide color photographic light sensitive material which comprises a support having coated thereon at least one silver halide emulsion layer containing a) an alkoxybenzoylacetanilide DIR coupler having, bonded directly to the coupling active position, a group which provides a compound having a development inhibiting property when the group is released from the coupler active position upon the color development reaction, wherein said group is a 4,7-dihalogen-2-benzotriazolyl group and b) an alkoxybenzoylacetanilide yellow dye forming coupler having a 3-hydantoinyl leaving group bonded to the coupling active position wherein said alkoxybenzoylacetanilide DIR coupler is represented by the formula:

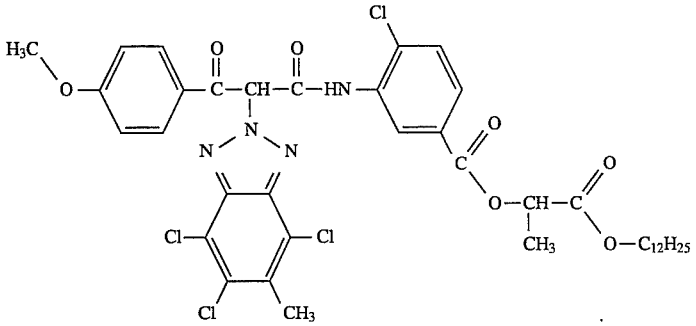

or by the formula:

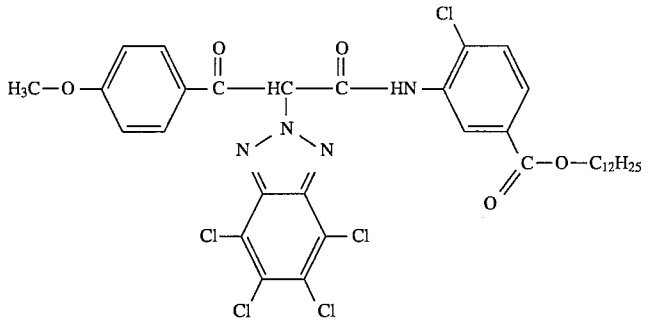
and wherein said alkoxybenzoylacetanilide yellow dye forming coupler is represented by the formula:
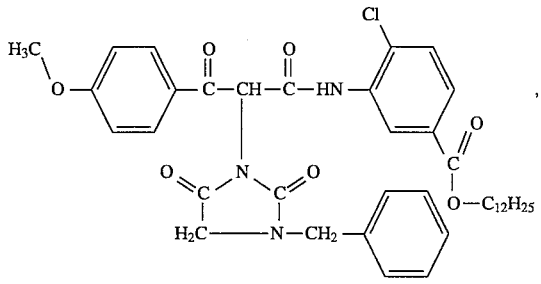
* * * * *